US007509075B2

(12) United States Patent
Hayakawa

(10) Patent No.: US 7,509,075 B2
(45) Date of Patent: Mar. 24, 2009

(54) GEAR UNIT AND IMAGE FORMING DEVICE

(75) Inventor: Atsushi Hayakawa, Okazaki (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 11/644,939

(22) Filed: Dec. 26, 2006

(65) Prior Publication Data

US 2007/0147895 A1 Jun. 28, 2007

(30) Foreign Application Priority Data

Dec. 27, 2005 (JP) ..... 2005-375587

(51) Int. Cl.
*G03G 15/00* (2006.01)

(52) U.S. Cl. ..... 399/167; 399/111

(58) Field of Classification Search ..... 399/167, 399/299, 179, 168, 111; 16/38; 74/10.8, 74/815, 10.41, 813, 10
See application file for complete search history.

(56) References Cited

U.S. PATENT DOCUMENTS

| | | | | |
|---|---|---|---|---|
| 5,787,323 | A * | 7/1998 | Nomura et al. | 399/111 |
| 6,072,968 | A * | 6/2000 | Nomura et al. | 399/113 |
| 6,909,866 | B2 * | 6/2005 | Kawai | 399/167 |
| 7,085,519 | B2 * | 8/2006 | Makino | 399/167 |
| 7,415,224 | B2 * | 8/2008 | Hayakawa | 399/111 |

FOREIGN PATENT DOCUMENTS

| | | |
|---|---|---|
| JP | 5-22920 | 3/1993 |
| JP | 10-109765 | 4/1998 |
| JP | 10-123785 | 5/1998 |
| JP | 2000-321836 | 11/2000 |
| JP | 2001-21023 | 1/2001 |

* cited by examiner

*Primary Examiner*—David M Gray
*Assistant Examiner*—G. M. Hyder
(74) *Attorney, Agent, or Firm*—McDermott Will & Emery LLP

(57) ABSTRACT

A gear unit is provided with a shaft, a gear, a first shaft support member, a second shaft support member, and a stopper. The gear is supported by the shaft. The gear is capable of rotating and moving along the shaft. The first shaft support member supports one end of the shaft. The second shaft support member supports the other end of the shaft. The stopper is supported by the shaft. The stopper is disposed between the gear and the second shaft support member. The stopper is capable of moving along the shaft. The stopper is configured such that the stopper does not drop off from the shaft in a case where the stopper moves toward the other end of the shaft in a state where the second shaft support member is not supporting the other end of the shaft. The stopper makes contact with the second shaft support member in a case where the stopper moves toward the other end of the shaft in a state where the second shaft support member is supporting the other end of the shaft. The gear makes contact with the stopper in a case where the gear moves toward the other end of the shaft.

13 Claims, 6 Drawing Sheets

GEAR UNIT AND IMAGE FORMING DEVICE

CROSS-REFERENCE TO RELATED APPLICATION

This application claims priority to Japanese Patent Application No. 2005-375587, filed on Dec. 27, 2005, the contents of which are hereby incorporated by reference into the present application.

BACKGROUND OF THE INVENTION

1. Field of the Invention

The present invention relates to a gear unit comprising a shaft, a gear, and a stopper.

2. Description of the Related Art

An image forming device, for example, has a gear unit for driving various rollers. Japanese Patent Application Publication No. 2000-321836, for example, teaches an image forming device comprising a gear unit. As shown in FIG. 1 of that document, the gear unit comprises a base member, a shaft extending from the base member, and a gear that rotates with the shaft as its axis. The gear is capable of moving along the shaft. The stopper is fixed to the base member. The majority of the stopper is disposed outwards, with respect to the gear, in the radial direction of the gear. A part of the stopper is disposed in a position that interferes with the gear, when the gear moves along the shaft (upward in FIG. 1 of the document). As a result, in the case where the gear is moved along the shaft when the gear unit is to be attached to a main body of the image forming device, the gear makes contact with the stopper and consequently the gear does not drop off from the shaft.

BRIEF SUMMARY OF THE INVENTION

In the conventional gear unit, the stopper is not supported by the shaft, but is fixed to the base member. As a result, the stopper is disposed outwards, with respect to the gear, in the radial direction of the gear. Consequently, the size of the gear unit is increased in the radial direction of the gear.

Further, in the case of a configuration where the gear can move along the shaft, if the gear receives thrust force while the gear is rotating, this gear slides along the shaft while still rotating. When the gear changes position while rotating there is a change in the positional relationship of this gear and another gear with which it is meshing. In this case, the transmission of driving force between the two gears becomes unstable.

The present specification sets forth a gear unit having a configuration that effectively deals with the above phenomenon.

A gear unit taught in the present specification comprises a shaft, a gear, a first shaft support member, a second shaft support member, and a stopper. The gear is supported by the shaft. The gear is capable of rotating and of moving along the shaft. The first shaft support member supports one end of the shaft. The first shaft support member may be formed integrally with the shaft, or may be formed separately from the shaft. The second shaft support member supports the other end of the shaft.

The stopper is supported by the shaft. The stopper is disposed between the gear and the second shaft support member. Consequently, the stopper does not need to be located outwards from the gear in the radial direction of the gear, and therefore the gear unit can be made smaller in the radial direction of the gear.

The stopper is capable of moving along the shaft. The stopper is configured such that the stopper does not drop off from the shaft in a case where the stopper moves toward the other end of the shaft in a state where the second shaft support member is not supporting the other end of the shaft. Consequently, when this shaft that is supporting the gear and the stopper is to be attached to the second shaft support member, the gear and the stopper are prevented from dropping off from the shaft when the gear moves toward the other end of the shaft.

The stopper makes contact with the second shaft support member in a case where the stopper moves toward the other end of the shaft in a state where the second shaft support member is supporting the other end of the shaft. The gear makes contact with the stopper in a case where the gear moves toward the other end of the shaft. As a result, the gear makes contact with the stopper and the stopper makes contact with the second shaft support member, for example, in a case where thrust force toward the other end of the shaft is exerted on the gear while the gear is rotating. The position of the gear during rotation is thus fixed. In this gear unit, the position of the gear during rotation is stable.

BRIEF DESCRIPTION OF THE DRAWINGS

FIG. 4 shows both a drive unit before it is attached to the left side plate and the drive unit after it has been attached to the left side plate. Further, FIG. 4 shows a cross-sectional view of a part of the left side plate and the drive portion.

DETAILED DESCRIPTION OF THE INVENTION

An embodiment of the present invention will be described in detail below with reference to the figures.

I: External Configuration of a Laser Printer

Figure 1:
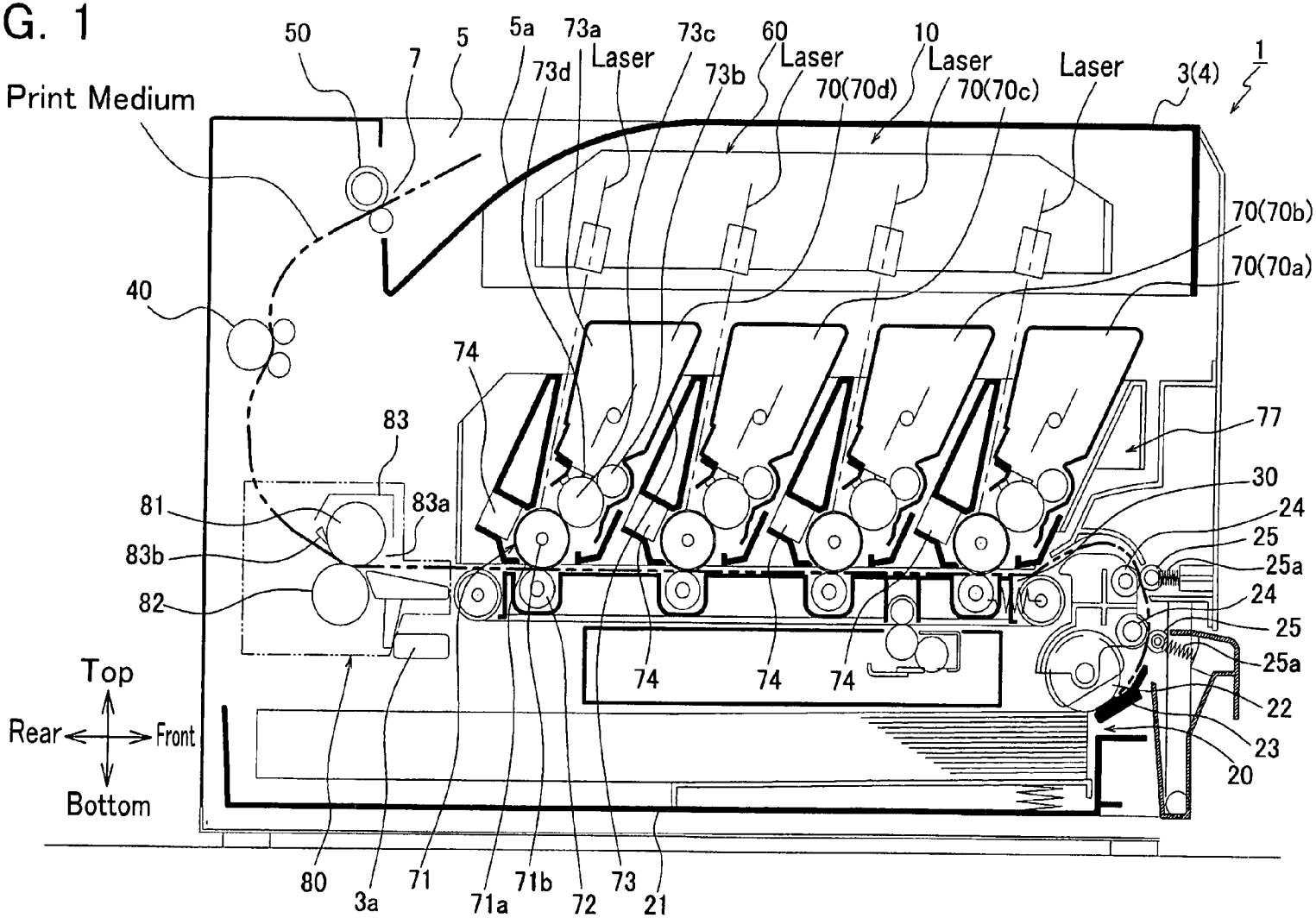
FIG. 1 shows a simplified cross-sectional view of a laser printer of the present embodiment.

FIG. 1 shows a simplified cross-sectional view of essential parts of a laser printer 1. The laser printer 1 is usually used with the right side of FIG. 1 used as the front.

The laser printer 1 has a case 3. The case 3 is substantially box shaped (substantially rectangular parallelepiped shaped). A paper discharge tray 5 is formed at a top face of the case 3. A print medium (paper, OHP sheet, etc.) that has been ejected from the case 3 is received by the paper discharge tray 5.

The case 3 has a frame member 4. The frame member 4 is made from metal or rubber, etc. An image transferring portion 70 (to be described), a fixing unit 80, etc. are connected removably to the frame member 4.

II: Frame Member 4

Figure 2:
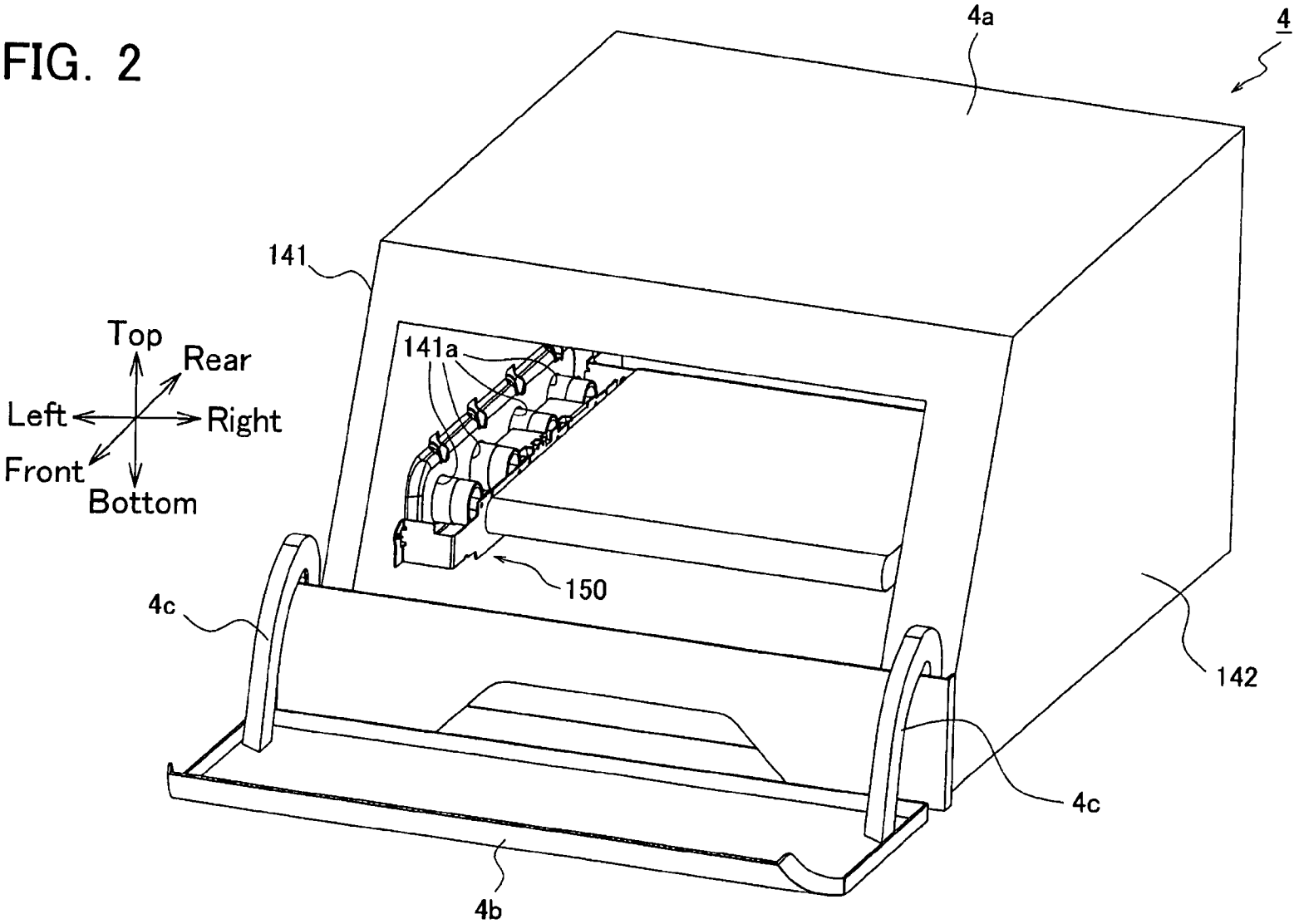
FIG. 2 shows a simplification of an inner part of the laser printer.

FIG. 2 shows a simplification of an inner part of the laser printer 1. The frame member 4 comprises a top cover 4*a*, a front cover 4*b*, hinges 4*c*, a left side plate 141, and a right side plate 142, etc.

The top cover 4*a* forms a top surface of the frame member 4. The front cover 4*b* forms a front surface of the frame member 4. The front cover 4*b* is supported by the hinges 4*c*.

A unit housing portion, in which a drum unit 77 (to be described: see FIG. 1, etc.) is disposed, is formed within the frame member 4. In FIG. 2, the drum unit 77 is not shown. Although this will be described in detail later, the drum unit 77 has four photoreceptor drums 71. The drum unit 77 can be attached to or removed from the frame member 4 when the front cover 4*b* is in an open state. The drum unit 77 is capable of housing four developer cartridges 73 (see FIG. 1, etc.).

Further, a drive portion 150 for driving the four photoreceptor drums 71 is disposed within the frame member 4.

III: Drive Portion 150

Figure 3:
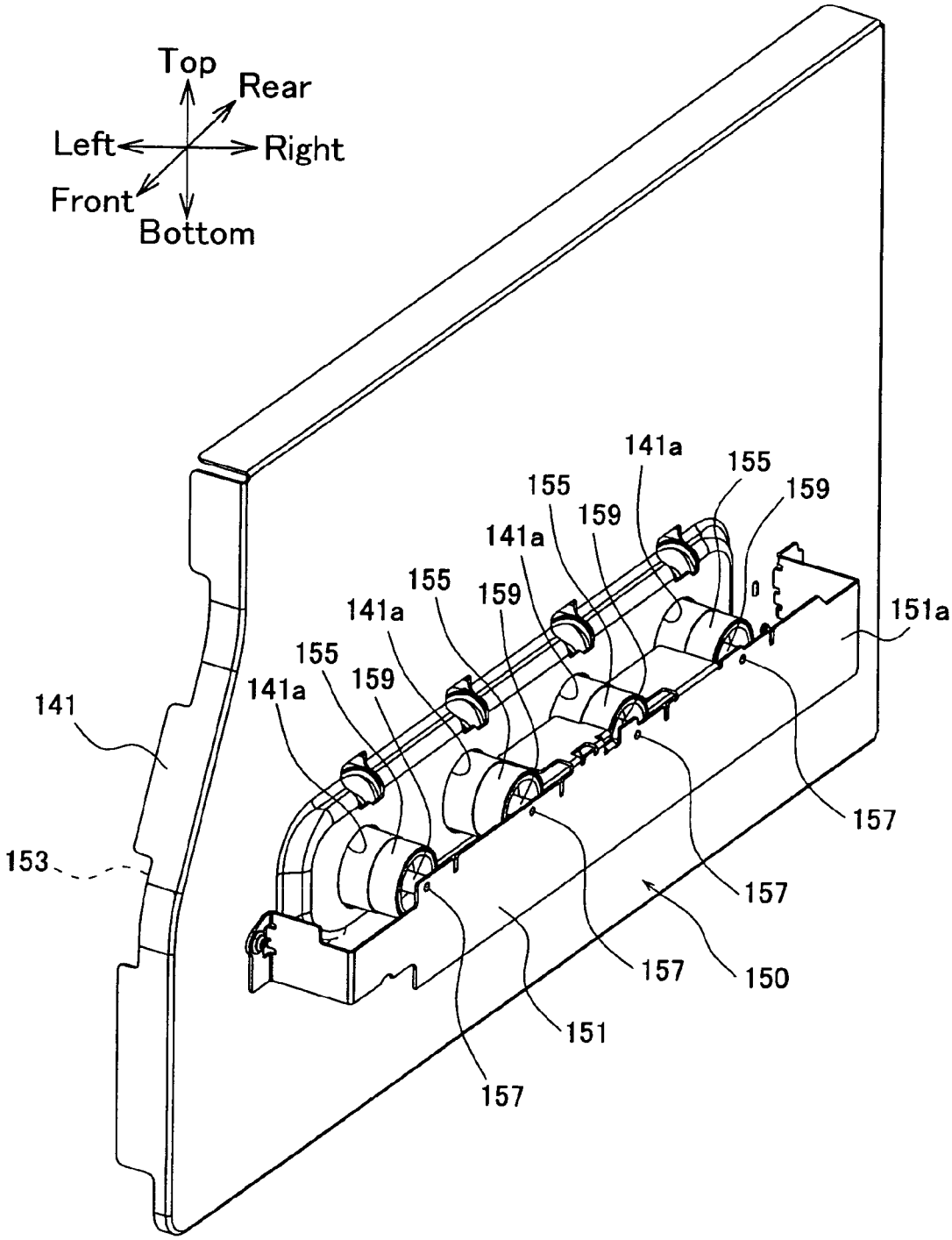
FIG. 3 shows a perspective view of a left side plate and a drive portion.

Next, the configuration of the drive portion 150 will be described. FIG. 3 shows a perspective view of the left side plate 141 and the drive portion 150.

Four through holes 141*a* are formed in a central location in the vertical direction of the left side plate 141. The four through holes 141*a* are aligned in the front-rear direction of the laser printer 1. The drive portion 150 comprises four drive gears 155. Each of the drive gears 155 is inserted through one corresponding through hole 141*a* from the left side of the left side plate 141.

Figure 4:
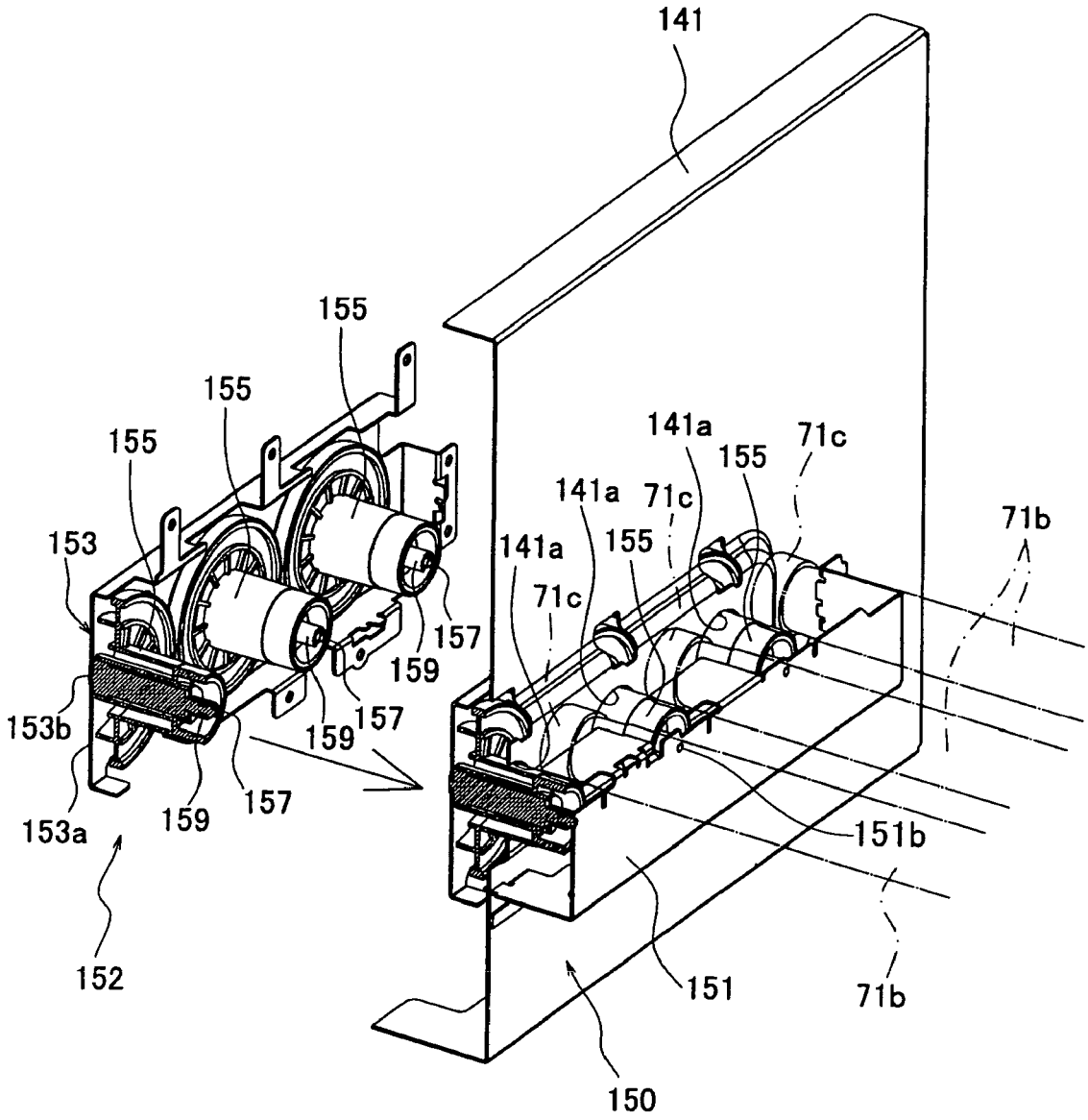
FIG. 4 shows a perspective view of the left side plate and the drive portion.

FIG. 4 shows a perspective view of the left side plate 141 and the drive portion 150. In FIG. 4, a cross-sectional view of a part of the left side plate 141 and the drive portion 150 is shown. The drive portion 150 comprises a main body side frame 151 and a drive unit 152.

The main body side frame 151 is a metal plate. In cross-section, the main body side frame 151 is substantially L-shaped. The main body side frame 151 is attached to a right surface of the left side plate 141. The main body side frame 151 covers the four through holes 141*a* of the left side plate 141 from an inner side of the device (from the right side).

Figure 5A:
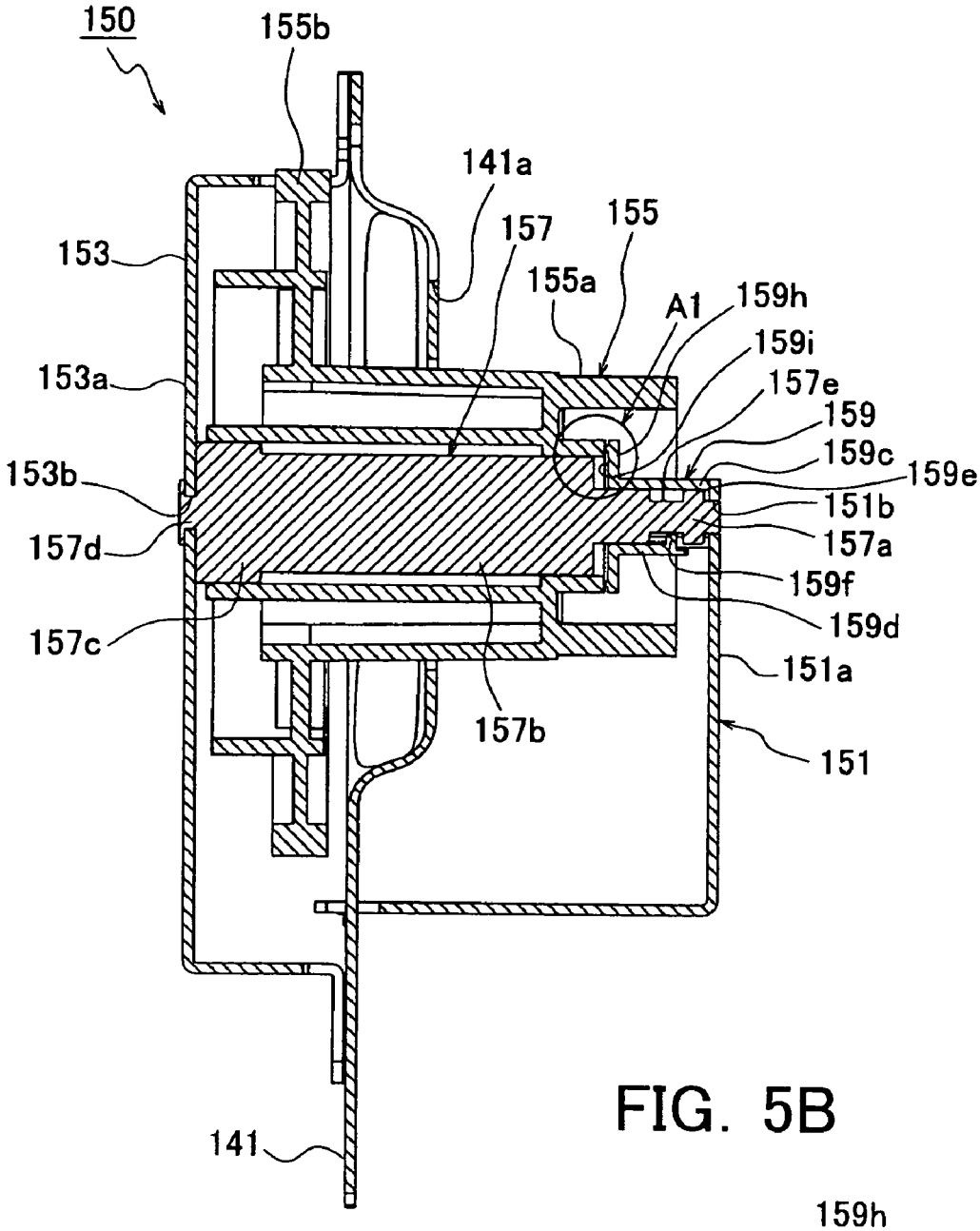
FIG. 5A shows a cross-sectional view of the drive portion.

FIG. 5A shows a cross-sectional view of the drive portion 150. The main body side frame 151 comprises a part 151*a* that extends in the vertical direction. Holes 151*b* are formed in the part 151*a*. Although only one hole 151*b* is shown in FIG. 5A, four holes 151*b* are actually present. The four holes 151*b* are aligned in the front-rear direction of the laser printer 1. A right end 157*a* of a shaft 157 (to be described) is inserted through one of the holes 151*b*. Corresponding shafts 157 are inserted respectively through the other three holes 151*b*.

As shown in FIG. 4, the drive unit 152 comprises a gear support member 153, the four drive gears 155, the four shafts 157, and four stoppers 159.

The gear support member 153 is a metal plate. The gear support member 153 comprises a first part extending in a vertical direction, a second part extending toward the right from a top edge of the first part, and a third part extending toward the right from a bottom edge of the first part. The gear support member 153 is attached to a left surface of the left side plate 141. The gear support member 153 covers the four through holes 141*a* of the left side plate 141 from an outer side of the device (from the left side).

Four through holes 153*b* are formed in a central portion 153*a* in the vertical direction of the gear support member 153. The four through holes 153*b* are aligned in the front-rear direction of the laser printer 1. A left end 157*d* (see FIG. 5A) of the shaft 157 is inserted through one of the holes 153*b*. The corresponding shafts 157 are inserted respectively through each of the other three holes 153*b*.

Next, the configuration of the drive gears 155 will be described with reference to FIG. 5A. Since the four drive gears 155 have the same configuration, the configuration of only one of the drive gears 155 will be described.

The drive gear 155 is substantially cylindrical. The drive gear 155 is a helical gear. The outer diameter of a left end portion 155*b* of the drive gear 155 is greater than the outer diameter of a tip end portion 155*a* thereof. A cog surface of the helical gear is formed at the tip end portion 155*a* of the drive gear 155.

As described above, the right end 157*a* of the shaft 157 is inserted into the hole 151*b* of the main body side frame 151. The right end 157*a* of the shaft 157 is thus supported by the main body side frame 151. The left end 157*d* of the shaft 157 is inserted into the hole 153*b* of the gear support member 153. The left end 157*d* of the shaft 157 is thus supported by the gear support member 153. The shaft 157 passes through the drive gear 155. The drive gear 155 is supported by a central portion 157*b* and a left end portion 157*c* of the shaft 157. The drive gear 155 is capable of rotating with the shaft 157 as its axis. The drive gear 155 is capable of moving in a left-right direction along the shaft 157.

The drive gear 155 is connected to a drive motor (not shown). The drive motor causes the drive gear 155 to rotate. As described above, there are four drive gears 155. The four drive gears 155 are aligned in the front-rear direction of the laser printer 1. Further, the drum unit 77 has the four photoreceptor drums 71. When the drive portion 150 has been attached to the left side plate 141 and the drum unit 77 is mounted in the unit housing portion, each of the drive gears 155 meshes with a drum gear 71*c* (see FIG. 7) of one corresponding photoreceptor drum 71.

The drive gear 155 transmits driving force (rotating force) to the drum gear 71*c*. The drive gear 155 receives counter force from the drum gear 71*c* that is rotating. Thrust force toward the right (the direction where the main body side frame 151 is present) is thus exerted on the drive gear 155.

The outer diameter of the central portion 157*b* of the shaft 157 is greater than the outer diameter of the tip end portion 157*a* thereof. The outer diameter of the left end portion 157*c* of the shaft 157 is greater than the outer diameter of the central portion 157*b* thereof. The central portion 157*b* and the left end portion 157*c* of the shaft 157 support the drive gear 155. The tip end portion 157*a* of the shaft 157 supports the stopper 159. The stopper 159 is capable of rotating with the shaft 157 as its axis. Further, the stopper 159 is capable of moving in a left-right direction along the shaft 157.

A concave portion 157*e* is formed in the tip end portion 157*a* of the shaft 157. The concave portion 157*e* extends in the left-right direction (the direction in which the shaft 157 extends). The concave portion 157*e* is formed in the entire range along a circumferential direction of the tip end portion 157*a*.

Figure 6A:
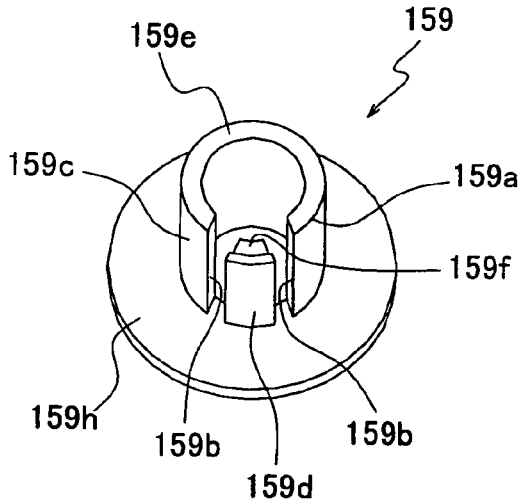
FIG. 6A shows a perspective view of the stopper.
Figure 6B:
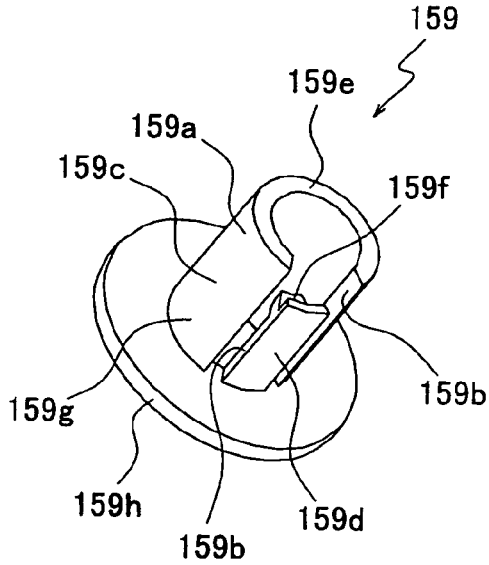
FIG. 6B shows a perspective view of the stopper viewed from a different direction from that of FIG. 6A.

The stopper 159 has a substantially cylindrical shape. The shape of the stopper 159 can be readily understood from FIGS. 6A and 6B.

Two notches 159*b* that extend in the axial direction of the shaft 157 are formed in a tip end portion 159*a* of the stopper 159. The tip end portion 159*a* of the stopper 159 is divided by these two notches 159*b* into a cylindrical portion 159*c* and a nail portion 159*d*. Due to being thin, the nail portion 159*d* is flexible. An end surface 159*e* of the cylindrical portion 159*c* is positioned further outward than the nail portion 159*d* (to the right in FIG. 5). That is, the cylindrical portion 159*c* extends rightward beyond the nail portion 159*d*.

The nail portion 159*d* comprises a protruding portion 159*f* that protrudes inward (upward in FIG. 5A) in a radial direction. When the stopper 159 is being supported by the shaft 157, the protruding portion 159*f* penetrates into the concave portion 157*e* of the shaft 157. The length of the concave portion 157*e* in the left-right direction of FIG. 5A is greater than the length of the protruding portion 159*f* in the left-right direction of FIG. 5A. As a result, the stopper 159 is capable of moving in the left-right direction of FIG. 5A. FIG. 5A shows the stopper 159 located furthermost to the right. That is, FIG. 5A shows the stopper 159 making contact with the main body side frame 151. In this state, there is a gap between the protruding portion 159*f* and a right end of the concave portion 157*e*. Further, there is also a gap between the protruding portion 159*f* and a left end of the concave portion 157*e*.

Figure 5B:
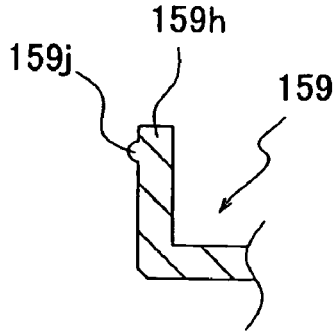
FIG. 5B shows a stopper present in the circle A1 in FIG. 5A.

A flange portion 159*h* is formed at a left end portion 159*g* (see FIG. 6) of the stopper 159. A ring shaped protrusion 159*j* is formed at an end surface 159*i* (see FIG. 5A) of the flange portion 159*h*. The protrusion 159*j* is shown in FIG. 5B. The shape of the protrusion 159*j* is determined such that a contact area between the protrusion 159*j* and the drive gear 155 is greater than a contact area between the end surface 159*e* and the main body side frame 151.

Next, the manner in which the drive portion 150 is attached to the frame member 4 will be described with reference to FIG. 4. First, the main body side frame 151 is attached to the right surface of the left side plate 141. Then the drive unit 152 is prepared.

The drive unit 152 is prepared as follows. First, the four shafts 157 are attached to the gear support member 153. Next, the drive gears 155 are attached to the shafts 157. Finally, the stoppers 159 are attached to the shafts 157. At this juncture, the protruding portions 159*f* of the nail portions 159*d* of the stoppers 159 penetrate into the concave portions 157*e* of the shafts 157. Since the nail portions 159*d* are flexible, the stoppers 159 can be attached to the shafts 157 while the nail portions 159*d* are being bent. The drive unit 152 is thus completed.

The main body side frame 151 is not attached to the drive unit 152 (the shafts 157) during the aforementioned steps of completing the drive unit 152. The protruding portions 159*f* of the stoppers 159 are inserted into the concave portions 157*e* of the shafts 157. As a result, while the shafts 157 are in an unattached state with respect to the main body side frame 151, the stoppers 159 do not drop off from the shafts 157 even when the stoppers 159 move toward the tip end portions 157*a* (see FIG. 5A) of the shafts 157. The drive gears 155 can thus be prevented from dropping off from the shafts 157.

The drive unit 152 is attached to the left side plate 141. At this juncture, the drive gears 155 (and the shafts 157 and stoppers 159) of the drive unit 152 pass through the through holes 141*a* of the left side plate 141. The tip end portions 157*a* (see FIG. 5A) of the shafts 157 pass through the holes 151*b* of the main body side frame 151. The tip end portions 157*a* of the shafts 157 are supported by the main body side frame 151. The drive portion 150 is thus completed.

As will be described in detail later, the stoppers 159 make contact with the drive gears 155 and the main body side frame 151. The position of the drive gears 155 is thus determined with respect to the drum gears 71*c* of the photoreceptor drums 71. The stoppers 159 can thus be said to co-operate with the main body side frame 151 to determine the position of the drive gears 155 with respect to the drum gears 71*c*.

IV: Paper Discharge Tray 5

As shown in FIG. 1, the paper discharge tray 5 comprises an oblique surface 5*a* that is inclined downward toward the rear. An ejecting portion 7 to which the print medium is ejected after printing is formed at a rear end side of the oblique surface 5*a*.

V: Feeder Portion 20

The feeder portion 20 comprises a paper supply tray 21, a feeding roller 22, a separating pad 23, etc. The paper supply tray 21 is housed at a lowermost portion of the case 3. The feeding roller 22 is formed above a front end portion of the paper supply tray 21. The feeding roller 22 conveys the print medium housed in the paper supply tray 21 to an image forming portion 10. The separating pad 23 is disposed in a position facing the feeding roller 22. The separating pad 23 applies a predetermined conveying resistance on the print medium. Consequently only one sheet of the plurality of sheets of print medium is conveyed.

VI: Conveying Portion

The print medium housed in the paper supply tray 21 makes a U-turn at a front side within the case 3, and is conveyed to the image forming portion 10 disposed at a substantially central portion in the case 3. A conveying roller 24 is disposed at the position where the print medium makes the U-turn. This conveying roller 24 applies conveying force to the print medium bending substantially in a U-shape.

A pressing roller 25 that presses the print medium against the conveying roller 24 is disposed in a position facing the conveying roller 24. The pressing roller 25 is pressed toward the conveying roller 24 by a resilient member such as a coiled spring 25*a*, etc.

The print medium that has made a U-turn is mounted on a conveying belt 30. The conveying belt 30 conveys the print medium to four image transferring portions 70*a* to 70*d* of the image forming portion 10.

A central conveying roller 40 conveys, to a discharge roller 50, the print medium that has moved past the image forming portion 10 (the fixing unit 80). The central conveying roller 40 functions to remove bending (curl) of the print medium that was generated in the image forming portion 10. The print medium that has been conveyed by the discharge roller 50 is ejected to the paper discharge tray 5 from the ejecting portion 7.

VII: Image Forming Portion 10

The image forming portion 10 comprises a scanner portion 60, the image transferring portion 70 (a process cartridge), the fixing unit 80, etc.

The image forming portion 10 of the present embodiment is capable of color printing. The image forming portion 10 uses the direct tandem method. Specifically, the four image transferring portions 70*a* to 70*d* that correspond to the four colors black, cyan, magenta and yellow are aligned in the conveying direction of the print medium.

VIII: Scanner Portion 60

The scanner portion 60 is formed at a top portion within the case 3. The scanner portion 60 forms electrostatic latent images on surfaces of the photoreceptor drums 71 of the four image transferring portions 70*a* to 70*d*. The scanner portion 60 includes a laser light source, a polygonal mirror, a fθ lens, a reflecting mirror, etc.

A laser beam based on image data and emitted from the laser light source is deflected by the polygonal mirror. The laser beam passes through the fθ lens, and is reflected by the reflecting mirror. The laser beam is further bent by another reflecting mirror. Then the laser beam irradiates the surfaces of the photoreceptor drums 71. The electrostatic latent images are thus formed on the surfaces of the photoreceptor drums 71.

IX: Image Transferring Portion 70 (Process Cartridge)

The four image transferring portions 70*a* to 70*d* have an identical configuration. The color of the toner housed in the image transferring portions 70*a* to 70*d* differs. Below, the configuration of the image transferring portion 70*d* will be described. Moreover, the four image transferring portions 70*a* to 70*d* will be referred as the image transferring portion 70.

The image transferring portion 70 is disposed at a lower side of the scanner portion 60. The image transferring portion 70 can be attached to and removed from the case 3. The image transferring portion 70 comprises the photoreceptor drum 71, a charger 74, a transfer roller 72, the developer cartridge 73, etc.

The image transferring portion 70 comprises the drum unit 77 that can be attached to or removed from the unit housing portion. The photoreceptor drum 71 and the charger 74 are formed integrally with the drum unit 77. The developer cartridge 73 is removably attached to the drum unit 77.

The photoreceptor drum 71 supports an image that is to be transferred to the print medium. The photoreceptor drum 71 comprises a drum main body 71*a*, a drum axis 71*b*, and a drum gear 71*c*.

The drum main body 71*a* has a cylindrical shape. A layer of the drum main body 71*a* furthermost to the surface side thereof is a positively charged photoreceptor layer such as polycarbonate or the like. The drum axis 71*b* is the axis of the drum main body 71*a*, and extends in the lengthwise direction of the drum main body 71*a*. The drum axis 71*b* rotatably supports the drum main body 71*a*.

Figure 7:
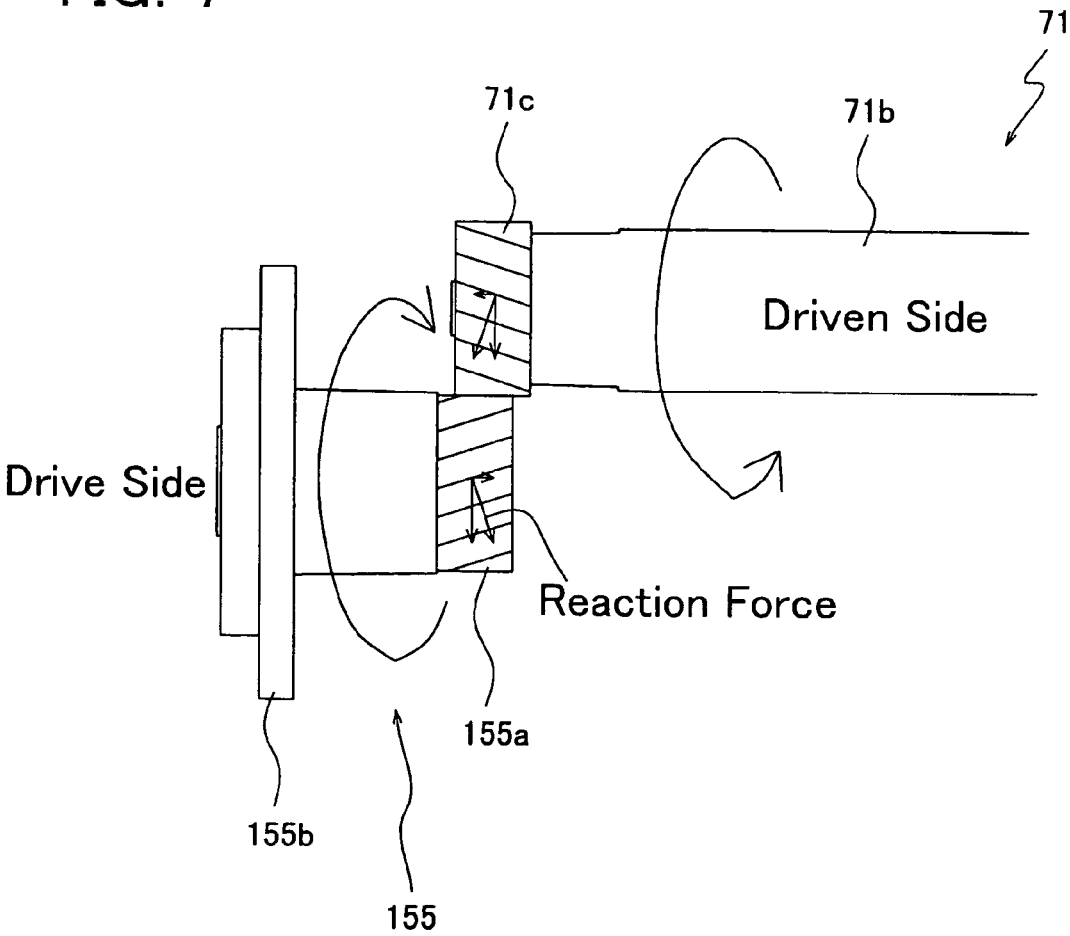
FIG. 7 shows a drive gear of the drive portion meshing with a drum gear of a photoreceptor drum.

As shown in FIG. 7, the drum gear 71*c* is connected to a left end of the drum axis 71*b* of the photoreceptor drum 71. The drum gear 71*c* is a helical gear. The drum gear 71*c* meshes with the drive gear 155. When the drive gear 155 rotates, the rotating force thereof is transmitted to the drum gear 71*c*, and the drum gear 71*c* rotates. The drum axis 71*b* and the drum main body 71*a* thus also rotate.

In the present embodiment, the helical gear of the drive gear 155 meshes with the helical gear of the drum gear 71*c* (the driven gear). The cog surface of the helical gear is inclined with respect to the direction of rotation of the gear. As a result, force (thrust force) is exerted on the helical gear in the direction of the rotational axis due to the effects of action and reaction of force. In the present embodiment, the drive gear 155 receives the thrust force toward the right in FIG. 7 (the direction at which the main body side frame 151 is present).

Moreover, the drum axis 71*b* is disposed at the right side of the drum gear 71*c*. Although this is not shown in FIG. 7, the drum main body 71*a* is disposed at the right side of the drum axis 71*b*. That is, the drum main body 71*a* and the drum axis 71*b* are downstream, with respect to the drum gear 71*c*, in the direction (rightward) of the force that the drive gear 155 receives.

The chargers 74 shown in FIG. 1 are disposed obliquely above of the photoreceptor drums 71. The chargers 74 face the photoreceptor drums 71. A gap is formed between the chargers 74 and the photoreceptor drums 71. The chargers 74 charge the surfaces of the photoreceptor drums 71.

The chargers 74 of the present embodiment are a scoroton type that utilize corona discharge to charge the surfaces of the photoreceptor drums 71 to a substantially homogeneous positive charge.

The transfer rollers 72 face the photoreceptor drums 71. When the photoreceptor drums 71 rotate, the transfer rollers 72 rotate following this rotation. When the print medium passes between the photoreceptor drums 71 and the transfer rollers 72, the transfer rollers 72 exert onto the print medium, from the side opposite a printing surface of the print medium, a charge that is the opposite of the charge to which the photoreceptor drums 71 were charged (i.e. the transfer rollers 72 exert a negative charge in the present embodiment). Toner that had adhered to the surface of the photoreceptor drums 71 is thus transferred to the printing surface of the print medium.

The developer cartridges 73 each comprise a toner housing chamber 73*a*, a supply roller 73*b*, a developing roller 73*c*, etc. The toner housing chamber 73*a* houses the toner. The toner housed in the toner housing chamber 73*a* is supplied to the developing roller 73*c* from the supply roller 73*b*. The toner that is being supported by the developing roller 73*c* is adjusted by a blade 73*d* to have a constant thickness. The toner that is being supported by the developing roller 73*c* is supplied to the surface of the photoreceptor drum 71 that has been exposed by the scanner portion 60.

X: Fixing Unit 80

The fixing unit 80 is disposed at a rear side of the photoreceptor drums 71. The fixing unit 80 heats the toner that has been transferred to the print medium, thus fixing the toner to the print medium. The fixing unit 80 is connected removably with the frame member 4.

The fixing unit 80 comprises a heating roller 81, a pressing roller 82, a case unit 83, etc. The heating roller 81 is disposed at the side where the printing surface of the print medium is located. The heating roller 81 applies conveying force to the print medium while heating the toner. The pressing roller 82 faces the heating roller 81. The pressing roller 82 presses the print medium toward the heating roller 81.

The heating roller 81 is driven by a motor, etc. (not shown). The pressing roller 82 is a following roller that follows the rotation of the heating roller 81.

The heating roller 81 and the pressing roller 82 are rotatably supported by the case unit 83. The case unit 83 has an inlet hole 83*a* that faces the image transferring portion 70, and an outlet hole 83*b* from which the print medium that has been heated is ejected.

XI: Outline of the Image Forming Operation

The image forming portion 10 forms images on the print medium in the manner described below.

The photoreceptor drums 71 are driven to rotate by the drive portion 150. The surfaces of the photoreceptor drums 71 are given a homogeneous positive charge by the chargers 74. Then the surfaces of the photoreceptor drums 71 are exposed by high speed scanning of the laser beam irradiated from the scanner portion 60. An electrostatic latent image that corresponds to the image to be formed on the print medium is thus formed on the surfaces of the photoreceptor drums 71.

The positively charged toner supported on the developing rollers 73*c* makes contact with the photoreceptor drums 71. This toner adheres to the parts of the surfaces of the photoreceptor drums 71 where the electrostatic latent image is formed (i.e. the parts of the photoreceptor drums 71 where the electric potential has been reduced by the exposure of the laser beam). The electrostatic latent image of the photoreceptor drums 71 is thus made visible, and a toner image is formed on the surfaces of the photoreceptor drums 71.

The toner image that is supported on the photoreceptor drums 71 is transferred to the print medium by transfer bias applied to the transfer rollers 72. The print medium to which the toner image has been transferred is heated by the fixing unit 80. The toner is thus fixed on the print medium, thus forming the image on the print medium.

As described above, the drive unit 152 of the present embodiment has an assembly of: the gear support member 153, the shaft 157, the drive gear 155, and the stopper 159. In this state, the drive unit 152 is not attached to the main body side frame 151. When the drive gear 155 moves toward the left end 157*d* (see FIG. 5A) of the shaft 157, the drive gear 155 makes contact with the gear support member 153. The drive gear 155 does not drop off from the shaft 157 even when the drive gear 155 moves toward the left end 157*d* of the shaft 157.

Further, in the state where the shaft 157 is not being supported by the main body side frame 151, the stopper 159 does not drop off from the shaft 157 even when the stopper 159 moves toward the right end 157*a* of the shaft 157. As a result, the drive gear 155 does not drop off from the shaft 157 even when the drive gear 155 moves toward the right end 157*a* of the shaft 157.

In the present embodiment, the drive gear 155 can be prevented from dropping off from the shaft 157 when the drive unit 152 is to be attached to the main body side frame 151.

Further, the stopper 159 of the present embodiment has a configuration wherein it is supported by the shaft 157, and is disposed between the drive gear 155 and the main body side frame 151. As a result, it is not necessary to dispose the stopper 159 outward with respect to the drive gear 155 in the radial direction of the drive gear 155. The drive unit 152 (and the drive portion 150) can consequently be made smaller in the radial direction of the drive gear 155.

As described above, the drive gear 155 receives thrust force toward the right of FIG. 5A during rotation. The drive gear 155 consequently moves toward the right along the shaft 157. When the drive gear 155 moves toward the right, the drive gear 155 makes contact with the stopper 159. When the drive gear 155 moves further toward the right, the stopper 159 is pushed toward the right by the drive gear 155. The stopper 159 thus moves toward the right along the shaft 157. When the stopper 159 moves toward the right, the stopper 159 makes contact with the main body side frame 151. The drive gear 155 consequently cannot move further to the right, and the position of the drive gear 155 is thus determined. That is, the position of the drive gear 155 while rotating is determined by the stopper 159 making contact with the main body side frame 151 and by the drive gear 155 making contact with the stopper 159. The position of the drive gear 155 while rotating is consequently stable. As a result, the positional relationship between the drive gear 155 and the drum gear 71*c* is made stable. The driving force is stably transmitted from the drive gear 155 to the drum gear 71*c*. Consequently, the processes such as developing, exposure, transfer, etc. are executed stably. It is thus possible to improve the quality of the image formed on the print medium.

The drive gear 155 and the drum gear 71*c* are helical gears. The drive gear 155 is consequently pushed toward the main body side frame 151 when this drive gear 155 rotates. By utilizing these helical gears, it is possible to exert the thrust force on the drive gear 155 toward the main body side frame 151 without providing a means (such as a spring for example) for pushing the drive gear 155.

The drive gear 155 is a gear for driving the photoreceptor drum 71. It is not possible to form high quality images on the print medium if the photoreceptor drums 71 are not driven in a stable manner. As a result, it is necessary that the driving force is transmitted stably between the drive gears 155 and the photoreceptor drums 71. In the present embodiment, there is a stable positional relationship between the drum gear 71*c* of the photoreceptor drum 71 and the drive gear 155 that is rotating, and consequently the driving force is transmitted stably from the drive gear 155 to the photoreceptor drum 71. High quality images can consequently be formed on the print medium.

Further, there are four drive gears 155 in the present embodiment. It is consequently possible to adjust the degree of rotation error of the photoreceptor drums 71, and thus to form the colors accurately on the print medium.

Further, the photoreceptor drums 71 of the present embodiment have the following configuration: the drum gear 71*c* is disposed at an upstream side with respect to the direction in which the thrust force is exerted on the drive gear 155, and the drum main body 71*a* and the drum axis 71*b* are disposed at a downstream side with respect to this direction. As a result, when the drive gear 155 is moved by the thrust force, there is an increase in the width between the drive gear 155 and drum gear 71*c* that are engaging together. The driving force is transmitted accurately from the drive gear 155 to the drum gear 71*c* due to the large width of the engagement between the drive gear 155 and drum gear 71*c*.

Moreover, the nail portion 159*d* of the stopper 159 is flexible, and consequently the stopper 159 can be attached to the shaft 157 while the nail portion 159*d* is being bent. The operation of attaching the stopper 159 to the shaft 157 can consequently be executed easily.

As shown in FIG. 5A, the cylindrical portion 159*c* of the stopper 159 extends further to the right than the nail portion 159*d*. As a result, the nail portion 159*d* does not make contact with the main body side frame 151 even when the cylindrical portion 159*c* of the stopper 159 is making contact with the main body side frame 151. The situation consequently does not occur wherein the nail portion 159*d* that bends easily is deformed due to making contact with the main body side frame 151. It is thus possible to prevent a change in position of the stopper 159 that is making contact with the main body side frame 151. The position of the drive gear 155 that is rotating can consequently be determined accurately.

Furthermore, in the present embodiment, the contact area between the drive gear 155 and the protrusion 159*j* of the stopper 159 is greater than the contact area between the main body side frame 151 and the end surface 159*e* of the stopper 159. It is thus possible to reduce the frictional force between the stopper 159 and the main body side frame 151 while the stopper 159 is rotating.

The above embodiment can be varied as described below.

(1) The drive portion 150 in the aforementioned embodiment drives the photoreceptor drums 71. However, the configuration of the drive portion 150 may equally well be utilized for driving other members of the laser printer 1. Further, the configuration of the drive portion 150 may be utilized in a device other than the laser printer 1.

(2) In the aforementioned embodiment, the concave portion 157*e* is formed in the shaft 157, and the protruding portion 159*f* is formed on the stopper 159. However, an opposite configuration thereto may equally well be adopted. That is, a protruding portion may be formed on the shaft 157, and a concave portion may be formed in the stopper 159.

What is claimed is:

1. A gear unit, comprising:

a shaft;

a gear supported by the shaft, the gear being capable of rotating and moving along the shaft;

a first shaft support member that supports one end of the shaft;

a second shaft support member that supports the other end of the shaft, and a stopper supported by the shaft, the stopper disposed between the gear and the second shaft support member, the stopper being capable of moving along the shaft, wherein the stopper is configured such that the stopper does not drop off from the shaft in a case where the stopper moves toward the other end of the shaft in a state where the second shaft support member is not supporting the other end of the shaft, the stopper makes contact with the second shaft support member in a case where the stopper moves toward the other end of the shaft in a state where the second shaft support member is supporting the other end of the shaft, and the gear makes contact with the stopper in a case where the gear moves toward the other end of the shaft.

2. The gear unit as in claim 1, wherein the gear that is rotating receives a force that makes the gear move toward the other end of the shaft.

3. The gear unit as in claim 2, wherein the gear is a helical gear.

4. The gear unit as in claim 2, wherein a position of the gear that is rotating is determined in a case where the stopper is making contact with the second shaft support member and the gear is making contact with the stopper.

5. The gear unit as in claim 1, wherein either one of the shaft or the stopper comprises a concave portion extending in a direction in which the shaft extends, the other one of the shaft and the stopper comprises a protruding portion that penetrates into the concave portion, and the width of the concave portion is greater than the width of the protruding portion in the direction in which the shaft extends.

6. The gear unit as in claim 5, wherein the stopper comprises a main portion and a nail portion having flexibility, and the nail portion has either one of the concave portion or the protruding portion.

7. The gear unit as in claim 6, wherein the main portion extends beyond the nail portion toward the other end of the shaft.

8. The gear unit as in claim 5, wherein, in a state where the stopper is making contact with the second shaft support member, there is a gap between the protruding portion and one end of the concave portion, and there is a gap between the protruding portion and the other end of the concave portion.

9. The gear unit as in claim 1, wherein the stopper is configured such that a contact area between the stopper and the gear is greater than a contact area between the stopper and the second shaft support member.

10. The gear unit as in claim 1, wherein the gear is a drive gear that meshes with the other gear.

11. An image forming device, comprising:

a photoreceptor drum comprising a drum main body and a drum gear coupled with the drum main body, and the gear unit as in claim 10, wherein the gear of the gear unit meshes with the drum gear.

12. The image forming device as in claim 11, comprising:

a plurality of photoreceptor drums, and a plurality of gear units, wherein each of the photoreceptor drums comprises the drum gear, each of the photoreceptor drums corresponds to one different gear unit, and the gear of each of the gear units meshes with the drum gear of a corresponding photoreceptor drum.

13. The image forming device as in claim 11, wherein the gear that is rotating receives a force making the gear move toward the other end of the shaft, and the drum main body is disposed at a downstream side of the drum gear in the direction of the force.

* * * * *